US009202653B2

(12) United States Patent
Sakai et al.

(10) Patent No.: US 9,202,653 B2
(45) Date of Patent: Dec. 1, 2015

(54) ELECTROMAGNETIC RELAY

(71) Applicant: FUJITSU COMPONENT LIMITED, Tokyo (JP)

(72) Inventors: Natsumi Sakai, Tokyo (JP); Masahiro Kaneko, Tokyo (JP); Nobuo Yatsu, Tokyo (JP); Takuya Uchiyama, Tokyo (JP); Kohei Takahashi, Tokyo (JP); Katsuaki Koshimura, Tokyo (JP)

(73) Assignee: FUJITSU COMPONENT LIMITED, Tokyo (JP)

( * ) Notice: Subject to any disclaimer, the term of this patent is extended or adjusted under 35 U.S.C. 154(b) by 0 days.

(21) Appl. No.: 14/099,161

(22) Filed: Dec. 6, 2013

(65) Prior Publication Data

US 2014/0240065 A1 Aug. 28, 2014

(30) Foreign Application Priority Data

Feb. 27, 2013 (JP) ..... 2013-037803

(51) Int. Cl.

| | |
|---|---|
| ***H01H 51/22*** | (2006.01) |
| ***H01H 51/06*** | (2006.01) |
| ***H01H 50/58*** | (2006.01) |
| ***H01H 50/64*** | (2006.01) |

(52) U.S. Cl.

CPC ..... *H01H 51/06* (2013.01); *H01H 50/58* (2013.01); *H01H 50/642* (2013.01); *H01H 50/647* (2013.01)

(58) Field of Classification Search

CPC ..... H01H 51/22; H01H 50/02; H01H 50/04; H01H 50/44; H01H 50/14; H01H 9/02; H01H 11/00; H01H 67/02

USPC ..... 335/78

See application file for complete search history.

(56) References Cited

U.S. PATENT DOCUMENTS

| | | | | | |
|---|---|---|---|---|---|
| 4,302,742 | A | * | 11/1981 | Schedele | 335/202 |
| 4,316,164 | A | * | 2/1982 | Essler | 335/202 |
| 4,420,733 | A | * | 12/1983 | Palandri | 335/202 |
| 4,429,292 | A | * | 1/1984 | Schedele | 335/202 |
| 4,529,952 | A | * | 7/1985 | Nagamoto et al. | 335/81 |
| 4,618,842 | A | * | 10/1986 | Nestlen et al. | 335/128 |
| 4,656,733 | A | * | 4/1987 | Maenishi et al. | 29/602.1 |
| 4,688,010 | A | * | 8/1987 | Nobutoki et al. | 335/128 |
| 4,740,769 | A | * | 4/1988 | Mitschik | 335/83 |
| 4,758,809 | A | * | 7/1988 | Bell | 335/128 |
| 4,761,627 | A | * | 8/1988 | Bell | 335/128 |
| 4,792,776 | A | * | 12/1988 | Lueneburger | 335/80 |
| 4,825,179 | A | * | 4/1989 | Nagamoto et al. | 335/80 |
| 5,017,898 | A | * | 5/1991 | Kuzukawa | 335/128 |
| 5,160,910 | A | * | 11/1992 | Tsuji | 335/129 |
| 5,202,663 | A | * | 4/1993 | Tomono et al. | 335/86 |
| 5,204,647 | A | * | 4/1993 | Mitsuki et al. | 335/80 |

(Continued)

FOREIGN PATENT DOCUMENTS

| | | |
|---|---|---|
| JP | 4-58933 | 5/1992 |
| JP | 2797261 | 9/1998 |

*Primary Examiner* — Shawki S Ismail
*Assistant Examiner* — Lisa Homza
(74) *Attorney, Agent, or Firm* — Staas & Halsey LLP

(57) ABSTRACT

An electromagnetic relay which is provided with an armature, a moving electrode which has a moving plate and a moving contact and a fixed electrode which faces the moving electrode and has a fixed plate and a fixed contact. At least a portion of the moving plate onto which the moving contact is arranged and at least a portion of the fixed plate onto which the fixed contact is arranged are inclined in width direction.

8 Claims, 10 Drawing Sheets

(56) References Cited

U.S. PATENT DOCUMENTS

| | | | | | |
|---|---|---|---|---|---|
| 5,289,144 | A * | 2/1994 | Liao | 335/78 |
| 5,525,948 | A * | 6/1996 | Poulsen | 335/128 |
| 5,680,082 | A * | 10/1997 | Stocklin | 335/128 |
| 5,757,255 | A * | 5/1998 | Noda et al. | 335/78 |
| 5,844,456 | A * | 12/1998 | Mader | 335/78 |
| 5,864,270 | A * | 1/1999 | Hoffman | 335/78 |
| 5,889,454 | A * | 3/1999 | Hendel | 335/177 |
| 5,907,268 | A * | 5/1999 | Mader | 335/202 |
| 5,969,586 | A * | 10/1999 | Noda et al. | 335/83 |
| 6,023,212 | A * | 2/2000 | Mader | 335/202 |
| 6,111,487 | A * | 8/2000 | Hoffmann et al. | 335/78 |
| 6,144,270 | A * | 11/2000 | Mader et al. | 335/78 |
| 6,265,958 | B1 * | 7/2001 | Yoshino et al. | 335/274 |
| 6,486,760 | B2 * | 11/2002 | Miyazaki et al. | 335/78 |
| 6,496,090 | B1 * | 12/2002 | Nishida et al. | 335/202 |
| 6,606,018 | B2 * | 8/2003 | Takano et al. | 335/78 |
| 6,621,394 | B2 * | 9/2003 | Ono et al. | 335/159 |
| 6,731,190 | B2 * | 5/2004 | Yamashita et al. | 335/78 |
| 6,765,462 | B2 * | 7/2004 | Noguchi | 335/128 |
| 6,940,375 | B2 * | 9/2005 | Sanada et al. | 335/86 |
| 7,046,107 | B2 * | 5/2006 | Yamamoto et al. | 335/128 |
| 7,477,119 | B2 * | 1/2009 | Wu | 335/83 |
| 7,782,162 | B2 * | 8/2010 | Nishida | 335/201 |
| 7,932,795 | B2 * | 4/2011 | Kozai et al. | 335/78 |
| 8,111,117 | B2 * | 2/2012 | Minowa et al. | 335/78 |
| 8,228,143 | B2 * | 7/2012 | Takano | 335/78 |
| 8,274,344 | B2 * | 9/2012 | Kato | 335/85 |
| 8,305,166 | B2 * | 11/2012 | Kojima et al. | 335/78 |
| 8,350,646 | B2 * | 1/2013 | Tan | 335/129 |
| 8,525,622 | B2 * | 9/2013 | Kubono | 335/78 |
| 2006/0181376 | A1 * | 8/2006 | Mikl et al. | 335/78 |
| 2006/0226937 | A1 * | 10/2006 | Takeda et al. | 335/78 |
| 2010/0066468 | A1 * | 3/2010 | Iwamoto et al. | 335/128 |
| 2012/0154077 | A1 * | 6/2012 | Mikl | 335/188 |
| 2012/0242432 | A1 * | 9/2012 | Nishimura et al. | 335/189 |
| 2013/0057370 | A1 * | 3/2013 | Kubono et al. | 335/177 |
| 2013/0285774 | A1 * | 10/2013 | Hasegawa et al. | 335/189 |

* cited by examiner

ELECTROMAGNETIC RELAY

CROSS-REFERENCE TO RELATED APPLICATIONS

This application is based upon and claims the benefit of priority of the prior Japanese Patent Application No. 2013-037803, filed Feb. 27, 2013, the entire contents of which are incorporated herein by reference.

BACKGROUND OF THE INVENTION

1. Field of the Invention

The present invention relates to an electromagnetic relay.

2. Description of the Related Art

As a device which is arranged in an electrical circuit to electrically connect and disconnect it, an electromagnetic relay is known. An electromagnetic relay is provided with an electromagnet, an armature which faces the electromagnet, and contacts which are connected to the armature. In the electromagnetic relay, when the coil is energized, the armature is pulled by the electromagnet causing the armature to move. Due to movement of the armature, the contacts are made to move and a plurality of contacts are electrically contacted or separated from.

Japanese Utility Model Publication No. 4-58933A discloses a polar relay which is provided with a moving member which includes a permanent magnet and can move when a coil is energized and a contact member which is formed so as to contact or separate from the moving member and which has a contact part which is inclined with respect to the axial direction.

Japanese Patent No. 2797261B2 discloses an electrical switching device which is provided with a moving contact plate and a fixed terminal plate, wherein the moving contact plate extends vertical to the up-down movement direction, that is, in a horizontal direction, and the fixed terminal plate descends somewhat to the outside in a direction of arrangement of a pair of moving contacts.

A general electromagnetic relay is structured by a base member which is formed by resin etc. to which a moving electrode plate and a fixed electrode plate are fixed. The moving electrode plate and fixed electrode plate are formed as elongated plate shapes and are arranged separated from each other. Operation of the armature is transmitted to the moving electrode plate, whereby the moving electrode plate deforms and contacts the fixed electrode plate. Further, the outside case which covers the electromagnet and other inside parts is formed into a rectangular parallelepiped shape. In this case, the moving electrode plate and fixed electrode plate are arranged so that their width directions become vertical or parallel to the outside surfaces of the case. When the moving electrode plate deforms, a switching operation is performed while maintaining a state where the width direction of the moving electrode plate and the width direction of the fixed electrode plate are parallel.

The electromagnetic relay which has such a rectangular parallelepiped shaped case is in many cases arranged on the surface of a board which extends in a horizontal direction or a board which extends in a vertical direction. For this reason, sometimes this is arranged so that the width direction of the moving electrode plate and the width direction of the fixed electrode plate become parallel to the horizontal direction.

In this regard, sometimes the inside of the case of an electromagnetic relay has foreign matter which has an insulating property remaining in it. For example, at the time of assembly of the electromagnetic relay, burrs which formed at the time of plastic molding drop down as foreign matter or dust etc. in the air invades the inside of the case as foreign matter. Further, sometimes electrode plates or other parts are press fit at a base member which is formed by resin etc. in the manufacturing process. In this case, sometimes the base member is scraped and forms foreign matter.

If such insulating foreign matter remains inside of the case and deposits on a moving contact of the moving electrode plate and a fixed contact of the fixed electrode plate, poor conduction will result when making the moving contact and the fixed contact contact each other. The moving contact of the moving electrode plate moves and contacts the fixed contact, so sometimes foreign matter which had deposited on the contacts drops off along with the operation. In this regard, as explained above, when the parts are arranged so that the width direction of the moving electrode plate and the width direction of the fixed electrode plate become parallel with the horizontal direction, sometimes foreign matter ends up being carried on the surfaces of the electrode plates and even if the moving electrode plate operates, the foreign matter remains without dropping off. For this reason, sometimes poor conduction occurs between the moving electrode plate and the fixed electrode plate.

SUMMARY OF THE INVENTION

The present invention has as its object the provision of an electromagnetic relay which suppresses poor conduction due to deposition of insulating foreign matter at the contacts of the electrode plates.

An aspect of an electromagnetic relay of the present invention is provided with an electromagnet, an armature which is pulled by the electromagnet when the electromagnet is energized, a moving electrode which has a moving plate and a moving contact wherein the moving contact is moved by operation of the armature, and a fixed electrode which faces the moving electrode and has a fixed plate and a fixed contact. At least a portion of the moving plate onto which the moving contact is arranged and at least a portion of the fixed plate onto which the fixed contact is arranged are inclined in width direction.

Another aspect of an electromagnetic relay of the present invention is provided with an electromagnet, an armature which is pulled by the electromagnet when the electromagnet is energized, a first moving electrode which has a first moving plate and a first moving contact wherein the first moving contact is moved by operation of the armature, a second moving electrode which is electrically connected to the first moving electrode and has a second moving plate and a second moving contact wherein the second moving contact is moved by operation of the armature, a first fixed electrode which faces the first moving electrode and has a first fixed plate and a first fixed contact, and a second fixed electrode which is electrically connected to the first fixed electrode, faces the second moving electrode, and has a second fixed plate and a second fixed contact. A direction of extension of a surface of the first moving plate where the first moving contact is arranged and a direction of extension of a surface of the second moving plate where the second moving contact is arranged intersect.

Still another aspect of an electromagnetic relay of the present invention is provided with a main body which includes an electromagnet which has a coil and a case inside of which the main body is fixed. The main body includes an armature which is pulled by the electromagnet when the coil is energized, a moving electrode plate which has a plate part and a moving contact where operation of the armature causes the moving contact to move, and a fixed electrode plate which faces the moving electrode plate and has a plate part and a fixed contact. The plate part of the moving electrode plate has a moving contact arrangement part at which the moving contact is arranged, while the plate part of the fixed electrode plate has a fixed contact arrangement part at which the fixed contact is arranged. The main body is inclined with respect to a mounting surface of an object to be mounted to when mounting the electromagnetic relay on the object to be mounted to, while the width direction of the moving contact arrangement part and the width direction of the fixed contact arrangement part are inclined with respect to the mounting surface.

DESCRIPTION OF EMBODIMENTS

Embodiment 1

Referring to FIG. 1 to FIG. 14, electromagnetic relays of the Embodiment 1 will be explained. FIG. 1 through FIG. 8 illustrates a first type of an electromagnetic relay of the embodiment ("first electromagnetic relay").

Figure 1:
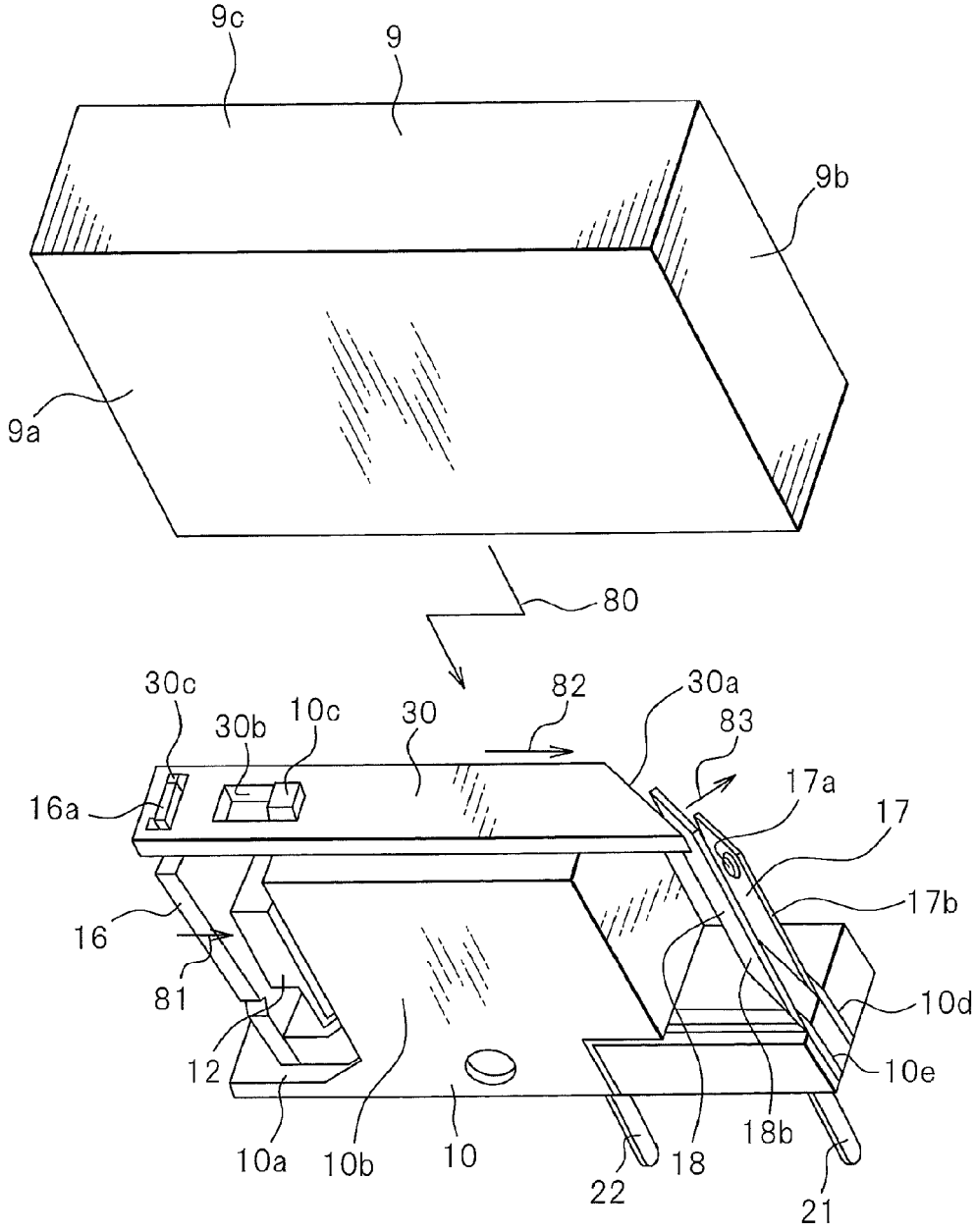
FIG. 1 is a disassembled perspective view of a first electromagnetic relay in an Embodiment 1.
Figure 2:
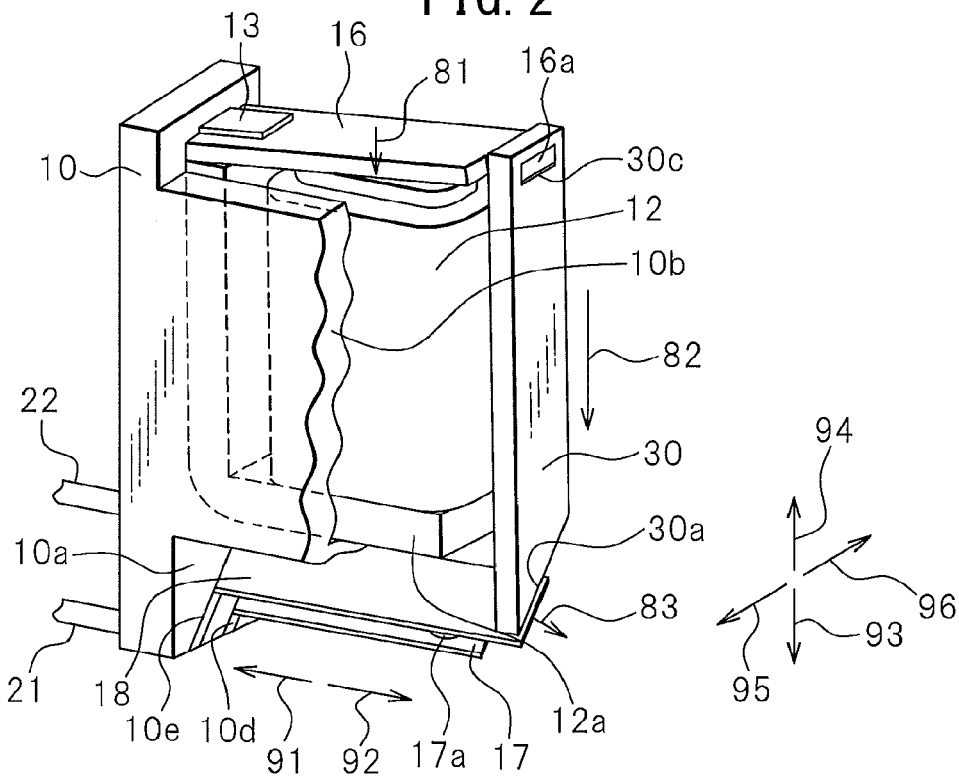
FIG. 2 is a schematic perspective view when detaching a case of the first electromagnetic relay of the Embodiment 1.
Figure 3:
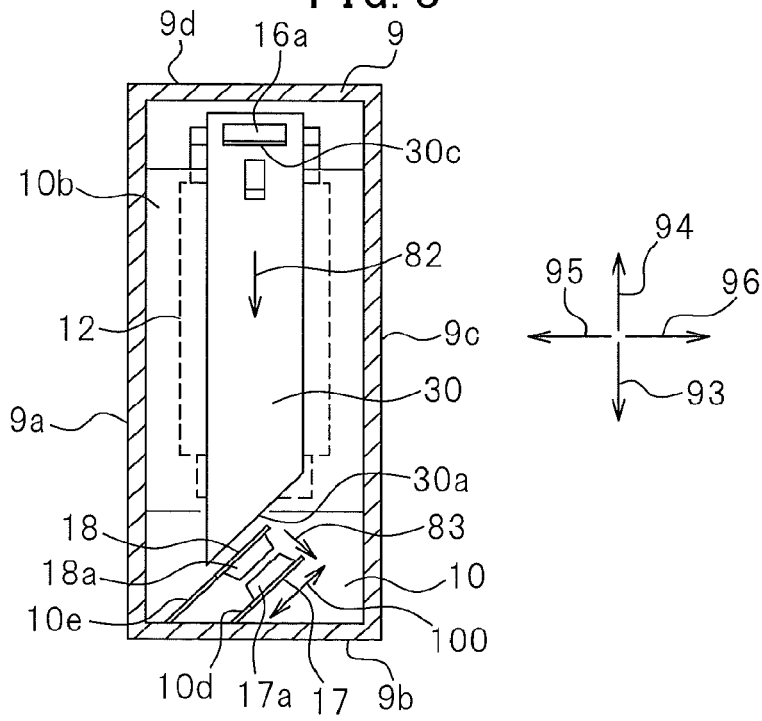
FIG. 3 is a schematic cross-sectional view when cutting the case of the first electromagnetic relay of the Embodiment 1.

FIG. 1 is a disassembled perspective view of the first electromagnetic relay of the present embodiment. FIG. 2 is a schematic perspective view when detaching a case of the first electromagnetic relay of the present embodiment. FIG. 3 is a schematic cross-sectional view of the first electromagnetic relay of the present embodiment.

Referring to FIG. 1 to FIG. 3, an electromagnetic relay is provided with an electromagnet 12. The electromagnet 12 has a yoke 12*a*. The electromagnet 12 is excited by energization of the coil. The generation of magnetic force is stopped by stopping the energization of the coil.

The electromagnetic relay of the present embodiment is provided with a base member 10. The base member 10 is formed by resin or other material which has an electrical insulating property. The base member 10 has a base part 10*a* which is formed in a plate shape and a support part 10*b* which is formed into a box shape. The electromagnet 12 is placed on the base part 10*a* and is arranged inside of the support part 10*b*. The electromagnet 12 is supported by the support part 10*b*. The coil inside of the electromagnet 12 is connected to a coil terminal for connection to an outside electrical circuit.

The electromagnetic relay has an armature 16 which is arranged so as to face the core of the electromagnet 12. The armature 16 is formed by a magnetic material into a plate shape. The armature 16 is fixed at one end to a plate spring 13. The plate spring 13 is fixed to the base part 10*a* of the base member 10. The plate spring 13 has elasticity and biases the armature 16 in a direction away from the electromagnet 12.

The electromagnetic relay is provided with a moving electrode plate 18 serving as a moving electrode. The moving electrode plate 18 includes a moving contact 18*a* and a plate part 18*b* serving as a moving plate. The plate part 18*b* is formed into a plate shape so as to be able to deform and to have elasticity. The plate part 18*b* is fixed at one end to the base part 10*a* of the base member 10. The moving electrode plate 18 is formed by a material which has electrical conductivity. The moving electrode plate 18 is connected to a terminal 22 which is connected to an outside electrical circuit.

The electromagnetic relay is provided with a fixed electrode plate 17 serving as a fixed electrode. The fixed electrode plate 17 has a fixed contact 17*a* and a plate part 17*b* serving as a fixed plate. The plate part 17*b* is formed into a plate shape. The plate part 17*b* is fixed to the base part 10*a* of the base member 10. The fixed electrode plate 17 is formed by a material which has electrical conductivity. The fixed electrode plate 17 is connected to a terminal 21 which is connected to an outside electrical circuit. The moving electrode plate 18 and the fixed electrode plate 17 are arranged so that the moving contact 18*a* and the fixed contact 17*a* face each other. The fixed electrode plate 17 and the moving electrode plate 18 are press fit into slits 10*d* and 10*e* which are formed in the base part 10*a* of the base member 10 by being pushed.

The armature 16 is connected to a card 30 at the end at the opposite side to the end to which the plate spring 13 is fixed. The card 30 functions as a moving member which moves with the armature 16. The card 30 of the present embodiment is formed to a plate shape. The card 30 is formed so as to transmit the movement of the armature 16 to the moving electrode plate 18. The plate part 18*b* is bent by the other end being pushed by the card 30.

The end of the card 30 is formed with an engagement hole 30*c*. The engagement hole 30*c* is engaged with an engagement part 16*a* which is formed at the armature 16. The card 30 is formed with an elongated hole 30*b* (not illustrated in FIG. 2) which extends in the longitudinal direction of the card 30. A projecting part 10*c* which projects from the top surface of the support part 10*b* of the base member 10 is inserted into the elongated hole 30*b*. By the projecting part 10*c* being inserted into the elongated hole 30*b*, movement of the card 30 in the width direction is suppressed.

The card 30 has a pushing part 30*a* which is arranged at the end which faces the moving electrode plate 18 and pushes the moving electrode plate 18. In an electromagnetic relay of the present embodiment, the end face of the card 30 pushes against the moving electrode plate 18. The pushing part 30*a* has an end face which is inclined with respect to the longitudinal direction of the card 30. The card 30 is formed so that the planar shape becomes trapezoidal.

The main body of the electromagnetic relay which includes the base member 10, the electromagnet 12 which is fixed to the base member 10, the fixed electrode plate 17, the moving electrode plate 18, etc. is covered by the case 9. The case 9 is formed in a rectangular parallelepiped shape. The case 9 is attached to the base member 10 as shown by the arrow 80. The case 9 has outer surfaces 9*a* to 9*e*. In the present embodiment, the outer surfaces 9*a* to 9*e* are formed to flat shapes.

When the coil of the electromagnet 12 is not being energized, the armature 16 is separated from the electromagnet 12 due to the biasing force of the plate spring 13. At this time, the moving contact 18*a* of the moving electrode plate 18 is separated from the fixed contact 17*a* of the fixed electrode plate 17. That is, the electromagnetic relay is opened.

When the coil of the electromagnet 12 is energized, a magnetic field is generated around the iron core of the electromagnet 12 and the armature 16 is pulled in by the electromagnet 12 in a direction as shown by the arrow 81. The engagement part 16*a* of the armature 16 pushes the engagement hole 30*c* of the card 30 and the card 30 moves in the longitudinal direction such as shown by the arrow 82. The card 30 pushes against the end of the moving electrode plate 18. The moving electrode plate 18, by being pushed by the card 30, bends toward the fixed electrode plate 17 as shown by the arrow 83. The moving contact 18*a* moves toward the fixed contact 17*a* and contacts the fixed contact 17*a*. As a result, the fixed contact 17*a* and the moving contact 18*a* become electrically conductive and the electromagnetic relay closes.

If the coil of the electromagnet 12 stops being energized, the elastic force of the plate spring 13 causes the armature 16 to move in a direction separating from the electromagnet 12. Due to operation of the armature 16, the card 30 moves in a direction opposite to the direction which is shown by the arrow 82. The moving contact 18*a* is separated from the fixed contact 17*a* to be electrically disconnected from the fixed contact 17*a*. In this way, the electromagnetic relay can make the fixed contact 17*a* and the moving contact 18*a* contact or separate from each other by the coil being energized or deenergized.

Figure 4:
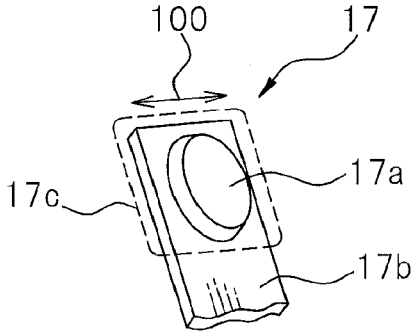
FIG. 4 is a perspective view of a fixed contact arrangement part of a fixed electrode plate.

FIG. 4 is a schematic perspective view of the part of the fixed electrode plate where the fixed contact is arranged. The fixed contact 17*a* is arranged at an end of the fixed electrode plate 17 in the longitudinal direction. The fixed contact 17*a* is formed so as to stick out from the surface of the plate part 17*b*. The fixed contact 17*a* is arranged at a fixed contact arrangement part 17*c* provided at an end of the plate part 17*b*.

Figure 5:
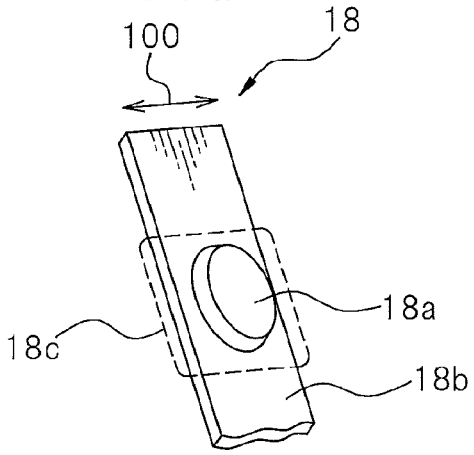
FIG. 5 is a perspective view of a moving contact arrangement part of a moving electrode plate.

FIG. 5 is a schematic perspective view of the part of the moving electrode plate where the moving contact is arranged. In the moving electrode plate 18 as well, in the same way as the fixed electrode plate 17, the moving contact 18*a* is arranged at an end in the longitudinal direction. The moving contact 18*a* of the present embodiment is formed so as to stick out from the surface of the plate part 18*b*. The plate part 18*b* has a moving contact arrangement part 18*c* at which the moving contact 18*a* is arranged. The moving electrode plate 18 and fixed electrode plate 17 are formed so that the fixed contact arrangement part 17*c* and the moving contact arrangement part 18*c* become substantially parallel to each other while the moving contact 18*a* and the fixed contact 17*a* face each other.

Referring to FIG. 3 to FIG. 5, the first electromagnetic relay of the present embodiment is structured with the width direction of the moving contact arrangement part 18*c* (direction of the arrow 100) and the width direction of the fixed contact arrangement part 17*c* (direction of the arrow 100) inclined with respect to at least one outer surface of the case 9. Referring to FIG. 3, the moving contact arrangement part 18*c* and the fixed contact arrangement part 17*c* are inclined with respect to the outer surfaces 9*a* to 9*e* of the case 9. Further, the surfaces of the plate parts 17*b* and 18*b* are inclined with respect to the outer surfaces 9*a* to 9*e* of the case 9. Further, the moving contact arrangement part 18*c* and the fixed contact arrangement part 17*c* are inclined with respect to the movement direction of the card 30 which is shown by the arrow 82.

Figure 6:
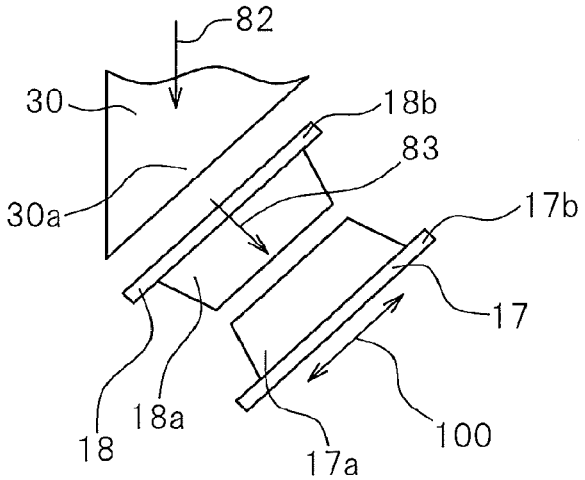
FIG. 6 is an enlarged schematic plan view of a card, a moving electrode plate, and a fixed electrode plate of the first electromagnetic relay of the Embodiment 1.

FIG. 6 is a schematic plan view of the pushing part of the card, the moving electrode plate, and the fixed electrode plate. The end face of the pushing part 30*a* of the card 30 has a shape substantially parallel to the surface of the plate part 18*b*. When the electromagnet 12 is energized and the card 30 moves in the direction which is shown by the arrow 82, the pushing part 30*a* pushes against the surface of the moving electrode plate 18. At this time, the pushing part 30*a* contacts the moving electrode plate 18. As the pushing part 30*a* of the card 30 has a shape which corresponds to the surface of the plate part 18*b* of the moving electrode plate 18, the area of the pushing part 30*a* which pushes against the moving electrode plate 18 becomes larger and the moving electrode plate 18 can be reliably pushed.

The electromagnetic relay of the present embodiment can be mounted in various directions when mounting to a board or other object to be mounted to. In FIG. 2 and FIG. 3, the direction in which gravity acts when mounting the electromagnetic relay in various directions, that is, the "gravity direction", is shown by the arrows 91 to 96.

When the electromagnetic relay is mounted to a board and the direction which is shown by the arrow 91 or the arrow 92 is the gravity direction, the longitudinal directions of the moving electrode plate 18 and fixed electrode plate 17 become parallel to the vertical direction. For this reason, foreign matter can be kept from depositing on the moving contact 18*a* and fixed contact 17*a*. Further, even if foreign matter deposits on the moving contact 18*a* and fixed contact 17*a*, the operation of the moving electrode plate 18 and the action of gravity can help the foreign matter drop off.

Next, when the electromagnetic relay is mounted to a board and any of the directions which are shown by the arrows 93 to 96 is the gravity direction, the moving contact arrangement part 18*c* and the fixed contact arrangement part 17*c* become inclined with respect to the gravity direction. For this reason, the width direction of the moving contact arrangement part 18*c* and the width direction of the fixed contact arrangement part 17*c* can be kept from becoming parallel with the horizontal direction. Even if foreign matter deposits on the moving contact 18*a* and fixed contact 17*a*, gravity acts in a direction causing the foreign matter to drop off and foreign matter can be kept from depositing on the moving contact 18*a* and the fixed contact 17*a*. Furthermore, due also to the operation of the moving electrode plate 18, foreign matter can be helped to drop off.

Figure 7:
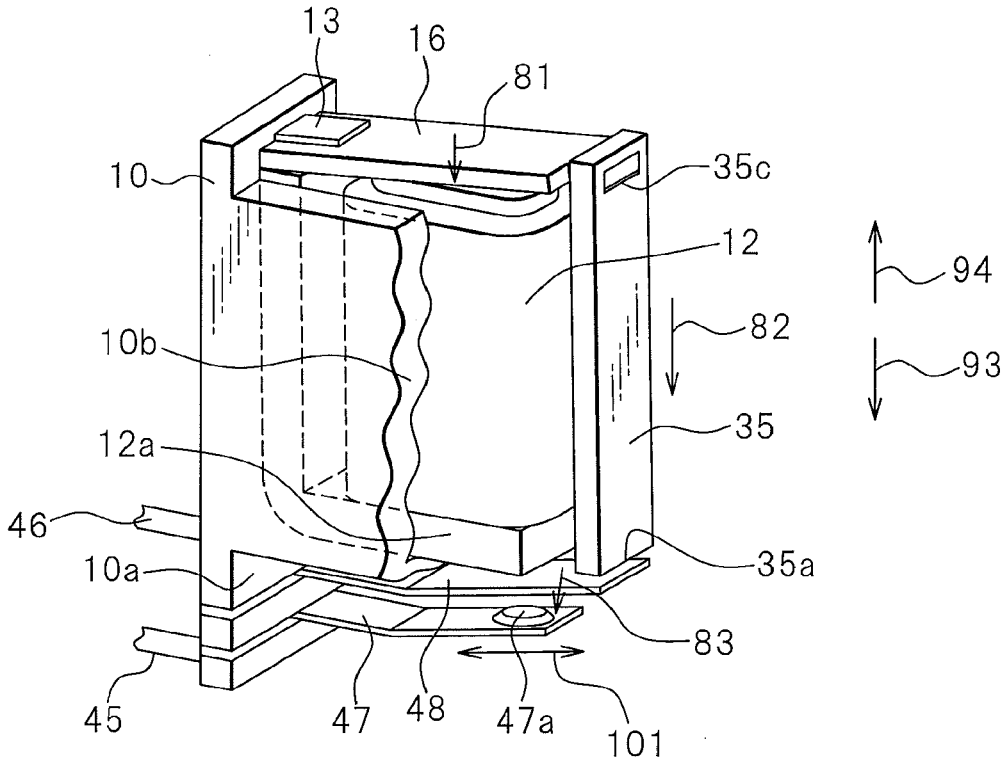
FIG. 7 is a schematic perspective view when detaching a case of an electromagnetic relay in a comparative example.
Figure 8:
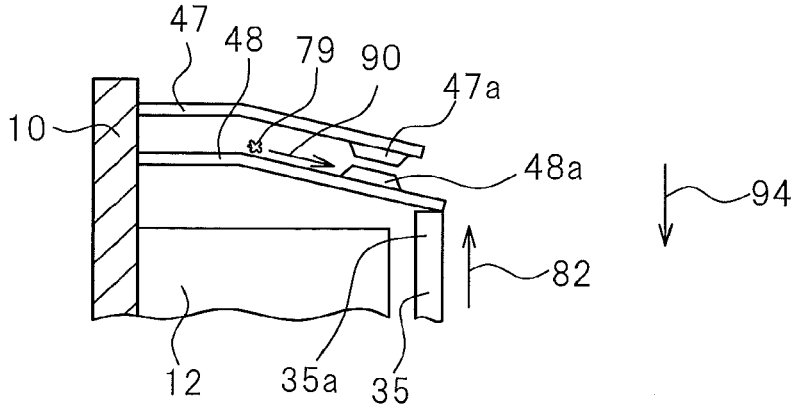
FIG. 8 is a schematic view of a part of a moving electrode plate and a fixed electrode plate when mounting the electromagnetic relay of the comparative example in a predetermined direction.

FIG. 7 and FIG. 8 are explanatory views of an electromagnetic relay of a comparative example. FIG. 7 is a schematic perspective view of the electromagnetic relay of the comparative example. FIG. 8 is an enlarged schematic view of the part of the moving electrode plate, the fixed electrode plate, and the front end of the card of the electromagnetic relay of the comparative example.

The electromagnetic relay of the comparative example is provided with a moving electrode plate 48 which has a moving contact 48*a* and a fixed electrode plate 47 which has a fixed contact 47*a*. The moving electrode plate 48 is connected to a terminal 46, while the fixed electrode plate 47 is connected to a terminal 45. Further, the electromagnetic relay of the comparative example is provided with a card 35 which has an engagement hole 35*c* and a pushing part 35*a*. The case of the electromagnetic relay of the comparative example is made one which is formed into a rectangular parallelepiped shape. The direction which is shown by the arrow 101 is the longitudinal direction of the moving electrode plate 48 and the fixed electrode plate 47.

Portions of the moving electrode plate 48 and fixed electrode plate 47 where the moving contact 48*a* and fixed contact 47*a* are formed are inclined with respect to the outer surfaces of the case. On the other hand, the width directions of the parts where the moving contact 48*a* and fixed contact 47*a* are formed are perpendicular to or parallel with the outer surfaces of the case.

If mounting the electromagnetic relay of the comparative example to a board in a certain direction, foreign matter can be kept from depositing on the moving contact 48*a* or fixed contact 47*a*. However, if the electromagnetic relay of the comparable example is mounted on a board in a direction illustrated in FIG. 8 and the gravity direction is the direction which is shown by the arrow 94, the foreign matter 79 may move along the surface of the moving electrode plate 48 as shown by the arrow 90 and deposits on the moving contact 48*a*. In this way, in the electromagnetic relay of the comparative example, foreign matter may end up being guided toward the contacts.

As opposed to this, even if mounting the first electromagnetic relay of the present embodiment in various directions, the moving contact arrangement part 18*c* and the fixed contact arrangement part 17*c* can be made to be inclined with respect to the gravity direction. For this reason, foreign matter can be kept from depositing on the moving contact 18*a* and fixed contact 17*a* and poor conduction between the moving contact 18*a* and the fixed contact 17*a* can be suppressed. Further, the foreign matter rolls along the surface of the electrode plate like in the comparative example, while the foreign matter can be kept from depositing on the contacts.

The first electromagnetic relay of the present embodiment is formed so that the moving contact arrangement part and the fixed contact arrangement part are inclined with respect to all outer surfaces of the case, but the invention is not limited to this. An electromagnetic relay may also be formed so that the width direction of the moving contact arrangement part and the width direction of the fixed contact arrangement part are inclined with respect to one or more outer surfaces of the case.

Further, in the first electromagnetic relay of the present embodiment, the plate part of the moving electrode plate and the plate part of the fixed electrode plate are provided standing up straight from the base member. That is, the plate parts extend in flat shapes, but the invention is not limited to this. A plate part may also be curved in the intermediate region from the base member to the moving contact arrangement part or fixed contact arrangement part.

Next, the second electromagnetic relay of the embodiment will be explained. In the second electromagnetic relay of the present embodiment, a plurality of electrode pairs of the moving electrode plates and the fixed electrode plates are formed.

Figure 9:
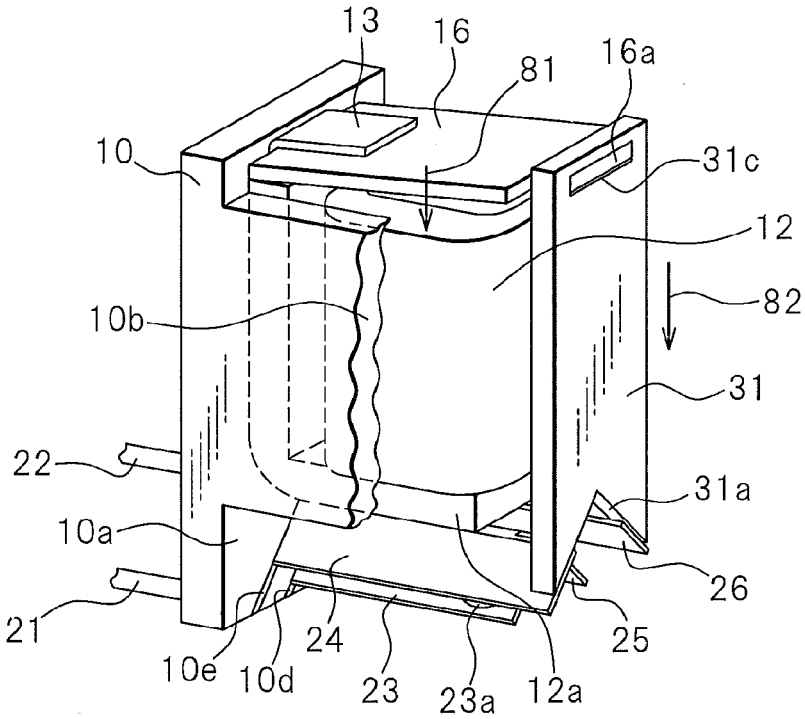
FIG. 9 is a schematic perspective view when detaching the case of the second electromagnetic relay of the Embodiment 1.
Figure 10:
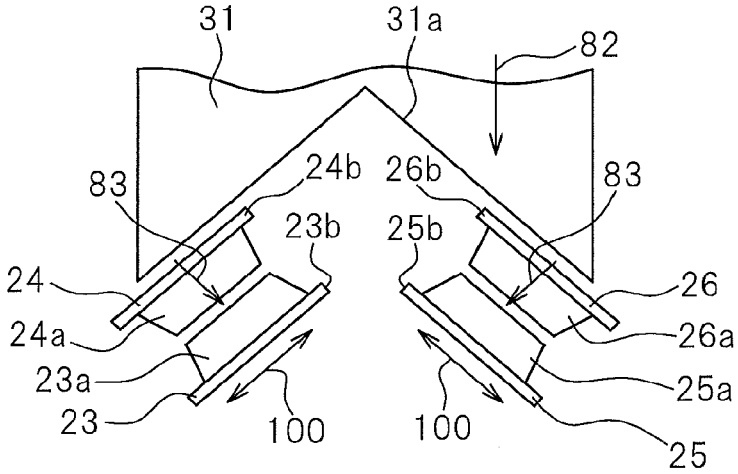
FIG. 10 is an enlarged schematic plan view of a card, moving electrode plates, and fixed electrode plates of a second electromagnetic relay of the Embodiment 1.

FIG. 9 is a schematic perspective view of the second electromagnetic relay of the present embodiment in which a case is detached. FIG. 10 is an enlarged schematic view of the part of the moving electrode plates, the fixed electrode plates, and the card of the second electromagnetic relay of the present embodiment. The second electromagnetic relay of the present embodiment is provided with a rectangular parallelepiped shaped case.

Referring to FIG. 9 and FIG. 10, the second electromagnetic relay of the present embodiment is provided with a first moving electrode plate 24 serving as a first moving electrode. The first moving electrode plate 24 has a moving contact 24*a* serving as a first moving contact and a plate part 24*b* serving as a first moving plate. The second electromagnetic relay is provided with a first fixed electrode plate 23 serving as a first fixed electrode. The first fixed electrode plate 23 has a fixed contact 23*a* serving as a first fixed contact and a plate part 23*b* serving as a first fixed plate. The plate part 24*b* of the first moving electrode plate 24 and the plate part 23*b* of the first fixed electrode plate 23 are formed with surfaces which extend in parallel to each other. The first moving electrode plate 24 has a first moving contact arrangement part, while the first fixed electrode plate 23 has a first fixed contact arrangement part. The first moving contact arrangement part and the first fixed contact arrangement part extend in parallel to each other.

Furthermore, the second electromagnetic relay of the present embodiment is provided with a second moving electrode plate 26 serving as a second moving electrode. The second moving electrode plate 26 has a moving contact 26*a* serving as a second moving contact and a plate part 26*b* serving as a second moving plate. The second electromagnetic relay is provided with a second fixed electrode plate 25 serving as a second fixed electrode. The second fixed electrode plate 25 has a fixed contact 25*a* serving as a second fixed contact and a plate part 25*b* serving as a second fixed plate. The plate part 26*b* of the second moving electrode plate 26 and the plate part 25*b* of the second fixed electrode plate 25 have surfaces which extend in parallel. The second moving electrode plate 26 has a second moving contact arrangement part, while the second fixed electrode plate 25 has a second fixed contact arrangement part. The second moving contact arrangement part and the second fixed contact arrangement part extend parallel to each other.

In the second electromagnetic relay of the present embodiment, the width direction of the first moving contact arrangement part of the first moving electrode plate 24 and the width direction of the second moving contact arrangement part of the second moving electrode plate 26 do not become parallel to each other but are formed so as to intersect. The direction in which the surface of the first moving contact arrangement part extends and the direction in which the surface of the second moving contact arrangement part extends intersect.

The card 31 has a pushing part 31*a* and an engagement hole 31*c*. The pushing part 31*a* is formed with a planar shape of a V-shape corresponding to the shapes of the moving electrode plates 24 and 26. The pushing part 31*a* has a shape where the end face which contacts the moving electrode plates 24 and 26 becomes substantially parallel to the surface of the plate parts 24*b* and 26*b*.

When the electromagnet 12 is energized, the armature 16 operates in the direction which is shown by the arrow 81, and the card 31 moves in the direction which is shown by the arrow 82. The pushing part 31*a* of the card 31 simultaneously pushes the both electrode plates of the first moving electrode plate 24 and the second moving electrode plate 26. The moving contact 24*a* of the first moving electrode plate 24 and the moving contact 26*a* of the second moving electrode plate 26 can be made to move as shown by the arrow 83 and can realize electrical conduction.

The first moving electrode plate 24 and the second moving electrode plate 26 are respectively electrically connected to the terminal 22. That is, the first moving electrode plate 24 and the second moving electrode plate 26 are electrically connected to each other. Further, the first fixed electrode plate 23 and the second fixed electrode plate 25 are respectively electrically connected to the terminal 21. That is, the first fixed electrode plate 23 and the second fixed electrode plate 25 are electrically connected to each other. In this way, in the second electromagnetic relay of the present embodiment, a plurality of switch parts are formed which connect or disconnect with a single electrical circuit.

In the first electromagnetic relay of the present embodiment, sometimes the electromagnetic relay is mounted to the board etc. so that the outer surfaces 9*a* to 9*d* of the case 9 is inclined with respect to the gravity direction. Depending upon the direction of mounting of the electromagnetic relay to the board etc. and the state of use of the device, sometimes the width direction of the fixed contact arrangement part 17*c* of the fixed electrode plate 17 and the width direction of the moving contact arrangement part 18*c* of the moving electrode plate 18 become substantially parallel with the horizontal direction.

As opposed to this, in the second electromagnetic relay of the present embodiment, even if the width direction of the moving contact arrangement part of one moving electrode plate is parallel to the horizontal direction, the width direction of the moving contact arrangement part of the other moving electrode plate is inclined with respect to the vertical direction or the horizontal direction. That is, the width direction of the moving contact arrangement part of the other moving electrode plate can be kept from becoming parallel to the horizontal direction. For this reason, at least one pair of the moving electrode plate and the fixed electrode plate becomes a state with a width direction inclined with respect to the gravity direction, so deposition of foreign matter can be suppressed or foreign matter can be helped to drop off. For this reason, for example, even if foreign matter deposits on the moving contact of one moving electrode plate and poor conduction occurs between one moving electrode plate and one fixed electrode plate, the other moving electrode plate and the other fixed electrode plate can realize electrical conduction between them. In this way, in the second electromagnetic relay of the present embodiment, even if mounting the electromagnetic relay in all sorts of directions, poor conduction due to foreign matter can be suppressed.

Figure 11:
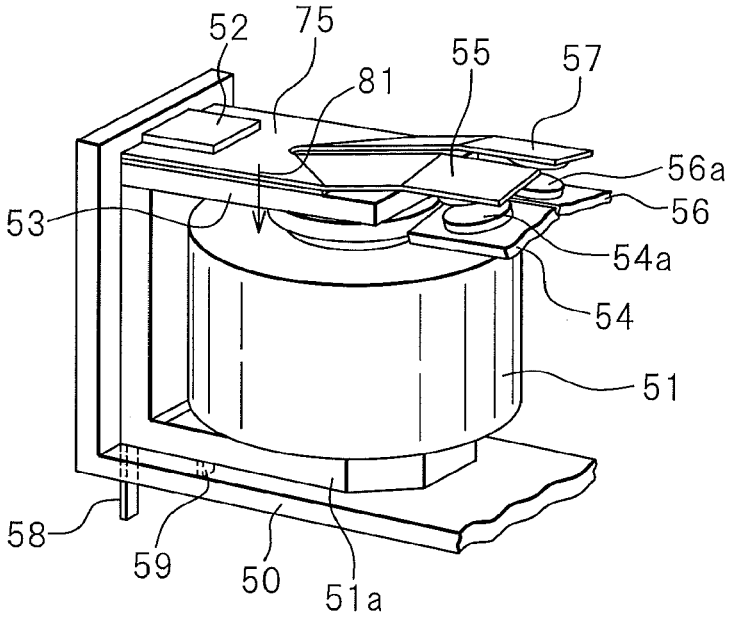
FIG. 11 is a schematic perspective view when detaching a case of a third electromagnetic relay of the Embodiment 1.
Figure 12:
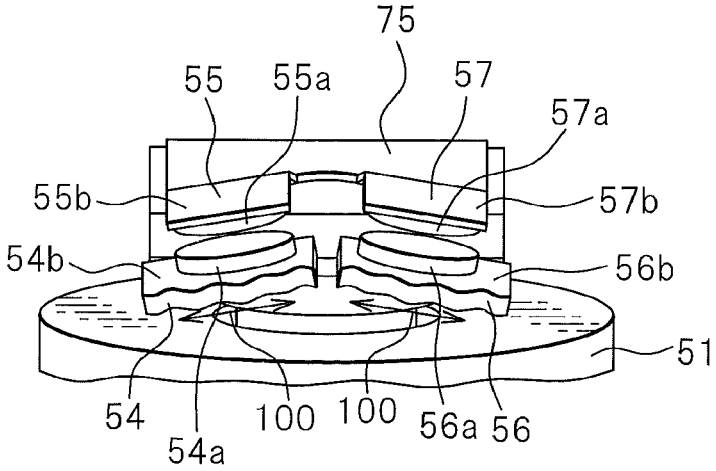
FIG. 12 is a schematic view of a part of moving electrode plates and fixed electrode plates of the third electromagnetic relay of the Embodiment 1.

FIG. 11 is a schematic perspective view when detaching a case of a third electromagnetic relay of the present embodiment. FIG. 12 is an enlarged schematic perspective view of the part of moving electrode plates and fixed electrode plates of the third electromagnetic relay of the present embodiment. In the third electromagnetic relay of the present embodiment as well, in the same way as the second electromagnetic relay of the present embodiment, pluralities of electrode pairs of moving electrode plates and fixed electrode plates are provided. The third electromagnetic relay of the present embodiment is provided with a rectangular parallelepiped shaped case.

Referring to FIG. 11 and FIG. 12, the third electromagnetic relay of the present embodiment is provided with a base member 50 and an electromagnet 51 which includes a yoke 51*a*. The third electromagnetic relay of the present embodiment is provided with a first moving electrode plate 55 serving as a first moving electrode, a first fixed electrode plate 54 serving as a first fixed electrode which faces the first moving electrode plate 55. The third electromagnetic relay is provided with a second moving electrode plate 57 serving as a second moving electrode, and a second fixed electrode plate 56 serving as a second fixed electrode which faces the second moving electrode plate 57. The first moving electrode plate 55 and the second moving electrode plate 57 respectively have moving contacts 55*a* and 57*a* and plate parts 55*b* and 57*b*. The moving contact 55*a* functions as a first moving contact and the moving contact 57*a* functions as a second moving contact. The plate parts 55*b* functions as a first moving plate and the plate part 57*b* functions as a second moving plate. The first moving electrode plate 55 has a first moving contact arrangement part, while the second moving electrode plate 57 has a second moving contact arrangement part. Further, the first fixed electrode plate 54 and the second fixed electrode plate 56 respectively have fixed contacts 54*a* and 56*a* and plate parts 54*b* and 56*b*. The fixed contact 54*a* functions as a first fixed contact and the fixed contact 56*a* functions as a second fixed contact. The plate parts 54*b* functions as a first fixed plate and the plate part 56*b* functions as a second fixed plate. The first fixed electrode plate 54 has a first fixed contact arrangement part, while the second fixed electrode plate 56 has a second fixed contact arrangement part.

The first moving electrode plate 55 and the second moving electrode plate 57 are connected to a common electrode plate 75. The first moving electrode plate 55 and the second moving electrode plate 57 are electrically connected with each other. The first moving electrode plate 55, second moving electrode plate 57, and common electrode plate 75 are fixed to the surface of the armature 53 and operate together with the armature 53. The plate spring 52 biases the armature 53 in a direction separating from the electromagnet 51. The common electrode plate 75 is connected to the terminal 58 which is connected with an outside electrical circuit.

The base member 50 supports the first fixed electrode plate 54 and the second fixed electrode plate 56. The first fixed electrode plate 54 and the second fixed electrode plate 56 are electrically connected to each other. The first fixed electrode plate 54 and second fixed electrode plate 56 are connected to a terminal 59 which is connected to an external electrical circuit.

In the third electromagnetic relay of the present embodiment, the moving electrode plates 55 and 57 operate integrally with the armature 53, so it is possible to make the moving contacts 55*a* and 57*a* move to electrically connect and disconnect the circuit. Further, in these electrode pairs, the moving contact arrangement parts and the fixed contact arrangement parts extend substantially in parallel with each other. Further, the width directions of the moving contact arrangement parts of the moving electrode plates 55 and 57 and the width directions of the fixed contact arrangement parts of the fixed electrode plates 54 and 56 are inclined with respect to the direction in which the armature 53 is pulled by the electromagnet 51.

In the third electromagnetic relay of the present embodiment as well, in the same way as the second electromagnetic relay of the present embodiment, the width direction of the first moving contact arrangement part of the first moving electrode plate 55 and the width direction of the second moving contact arrangement part of the second moving electrode plate 57 are formed so as not to become parallel with each other. Further, the direction in which the surface of the first moving contact arrangement part extends and the direction in which the surface of the second moving contact arrangement part extends intersect. For this reason, no matter in what direction the electromagnetic relay is attached, it is possible to suppress poor conduction to at least one electrode pair of the moving electrode plate and the fixed electrode plate.

In this way, the present invention can also be applied to an electromagnetic relay which is not provided with a card and which has a structure in which a moving electrode plate is fixed to the armature. Note that the third electromagnetic relay of the present embodiment has a plurality of electrode pairs of moving electrode plates and fixed electrode plates, but the invention is not limited to this. The invention can also be applied to an electromagnetic relay which has a single electrode pair of the moving electrode plate and the fixed electrode plate.

Figure 13:
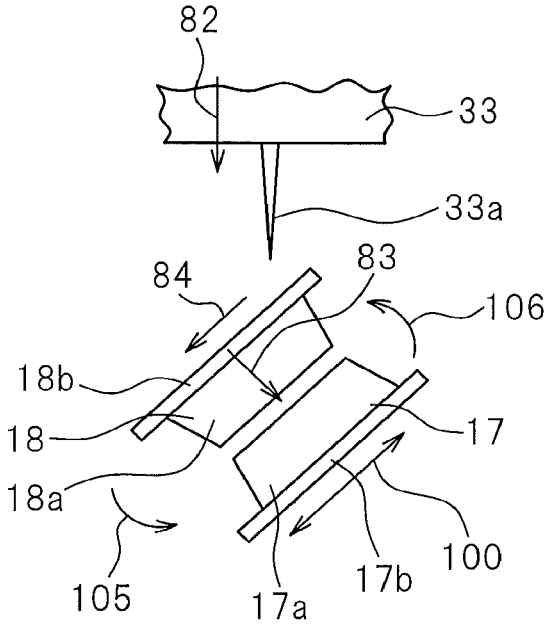
FIG. 13 is an enlarged schematic plan view of a pushing part of a card, a moving electrode plate, and a fixed electrode plate of a fourth electromagnetic relay of the Embodiment 1.

FIG. 13 is an enlarged schematic view which explains a pushing part of a card of a fourth electromagnetic relay of the present embodiment. In the fourth electromagnetic relay of the present embodiment, a card 33 pushes a moving electrode plate 18. Here, in the fourth electromagnetic relay of the present embodiment, the pushing part 33*a* of the card 33 is formed so that the front end becomes pointed. The pushing part 33*a* of the present embodiment is formed in a wedge shape. As the pushing part 33*a*, the invention is not limited to this. For example, it may also be formed to a needle shape with a pointed tip.

If the card 33 moves as shown by the arrow 82, the pushing part 33*a* contacts the plate part 18*b* of the moving electrode plate 18. After this, the pushing part 33*a* moves along the surface of the plate part 18*b* as shown by the arrow 84 while maintaining the contact state. At the moving electrode plate 18, as shown by the arrow 105, a force is generated by which the width direction of the moving contact arrangement part rotates. In the fixed electrode plate 17 as well, a force is generated by which the width direction of the fixed contact arrangement part rotates as shown by the arrow 106.

In this way, a force acts in a direction by which the moving electrode plate 18 and fixed electrode plate 17 are twisted, so the contact surface of the moving contact 18*a* and the contact surface of the fixed contact 17*a* slide. Even if there is foreign matter between the moving contact 18*a* and the fixed contact 17*a*, it is possible to make the foreign matter move along the contact surfaces and drop off. A so-called "wiping effect" is produced and foreign matter can be removed from between the contacts.

Figure 14:
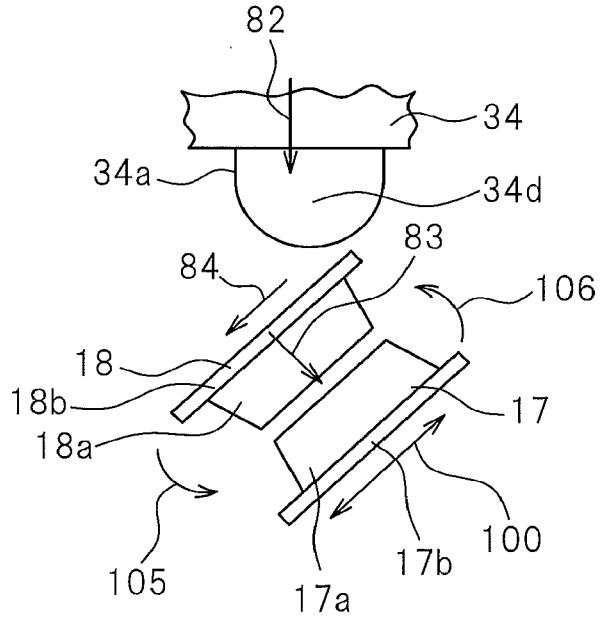
FIG. 14 is an enlarged schematic plan view of a pushing part of a card, a moving electrode plate, and a fixed electrode plate of a fifth electromagnetic relay of the Embodiment 1.

FIG. 14 is an enlarged schematic view which explains a pushing part of a card of a fifth electromagnetic relay of the present embodiment. The pushing part 34*a* of the card 34 of the fifth electromagnetic relay of the present embodiment is formed in a plate shape. The direction vertical to the paper surface of FIG. 14 becomes the thickness direction. The surface 34*d* of the pushing part 34*a* and the direction of movement of the surface of the plate part 18*b* of the moving electrode plate 18 which is shown by the arrow 84 become parallel. The pushing part 34*a* is formed with an end face which contacts the moving electrode plate 18 which has an arc-shaped cross-sectional shape.

In the fifth electromagnetic relay of the present embodiment as well, in the same way as the fourth electromagnetic relay of the present embodiment, by the pushing part 34*a* pushing against the moving electrode plate 18, a force acts which makes the moving contact arrangement part of the moving electrode plate 18 rotate in the direction which is shown by the arrow 105. Furthermore, a force acts which makes the fixed contact arrangement part of the fixed electrode plate 17 rotate in the direction which is shown by the arrow 106. For this reason, the contact surface of the moving contact 18*a* and the contact surface of the fixed contact 17*a* can slide and remove foreign matter.

The pushing part of the fifth electromagnetic relay of the present embodiment is formed to a plate shape, but the invention is not limited to this. A pushing part which has an end face which contacts the moving electrode plate which is curved in a projecting manner may also be employed. For example, the pushing part may be formed into a semispherical shape.

The electromagnetic relay of the present embodiment makes two contacts contact each other, but the invention is not limited to this. The present invention can also be applied to an electromagnetic relay which has three or more contacts and which electrically connects, disconnects, or switches any contacts.

Embodiment 2

Figure 15:
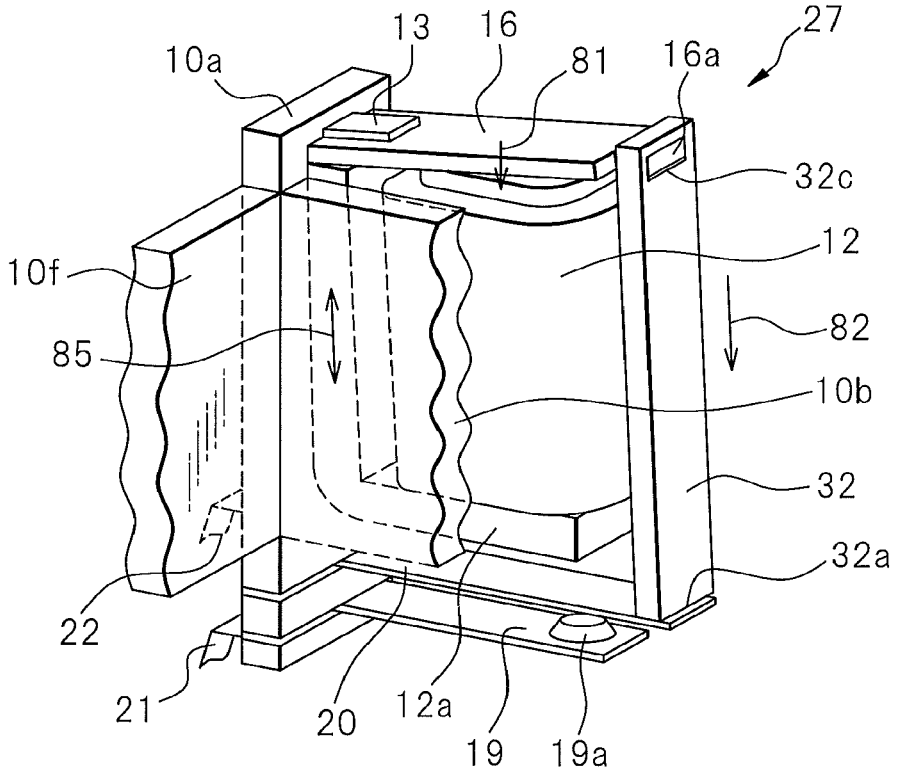
FIG. 15 is a schematic perspective view when detaching a case of a first electromagnetic relay in an Embodiment 2.
Figure 16:
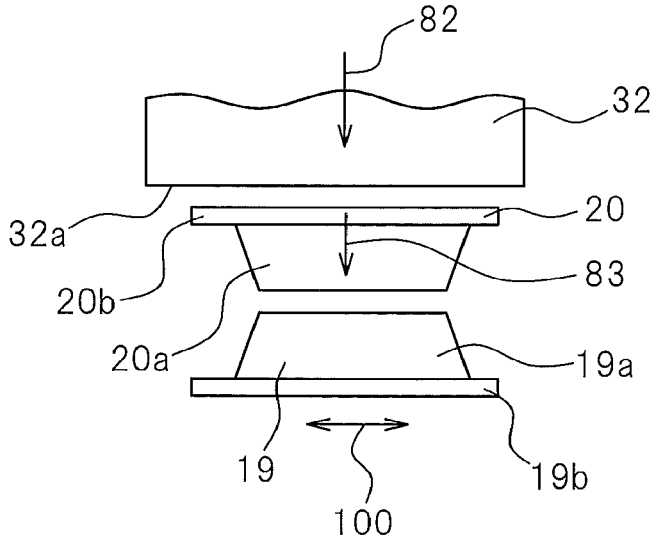
FIG. 16 is an enlarged schematic plan view of a card, a moving electrode plate, and a fixed electrode plate of the first electromagnetic relay of the Embodiment 2.
Figure 17:
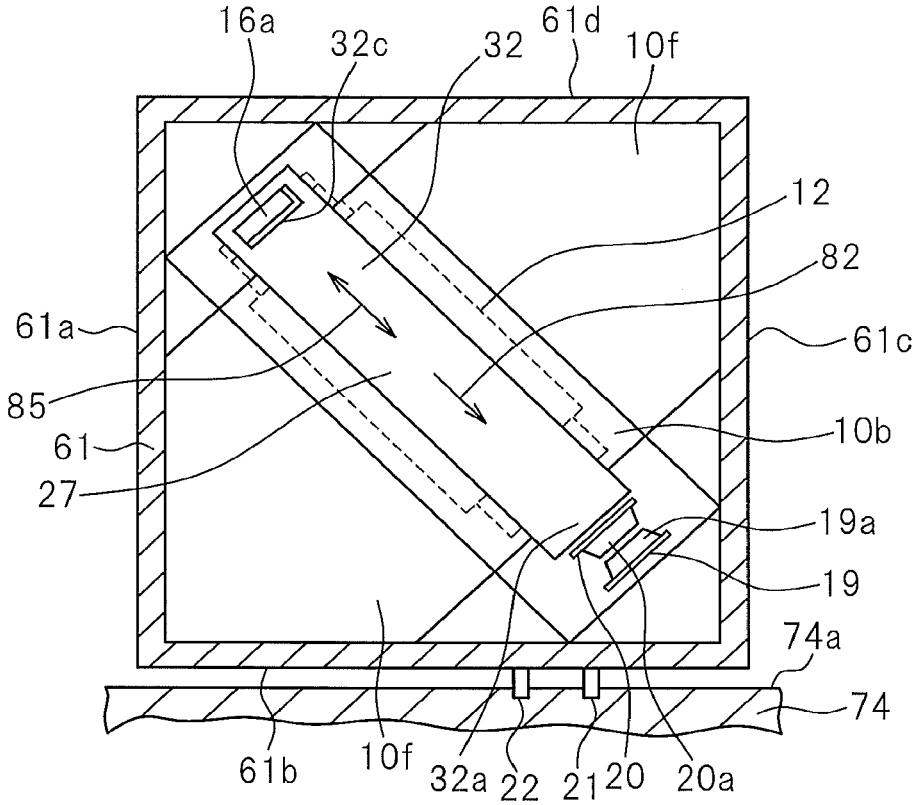
FIG. 17 is a schematic cross-sectional view when cutting the case of the first electromagnetic relay of the Embodiment 2.

Referring to FIG. 15 to FIG. 19, electromagnetic relays of the Embodiment 2 will be explained. FIG. 15 is a schematic perspective view when detaching a case of a first electromagnetic relay of the present embodiment. FIG. 16 is an enlarged schematic view of the part of a moving electrode plate, a fixed electrode plate, and a card of the first electromagnetic relay of the present embodiment. FIG. 17 is a schematic cross-sectional view when cutting the part of the case of the first electromagnetic relay of the present embodiment. The first electromagnetic relay of the present embodiment is arranged so that the main body 17 which includes the base member 10, the electromagnet 12, the card 32, and the moving electrode plate 20 is inclined inside of the case 61.

Referring to FIG. 15 to FIG. 17, the main body 27 of the first electromagnetic relay of the present embodiment is provided with a moving electrode plate 20 which includes a moving contact 20*a* and a plate part 20*b* and with a fixed electrode plate 19 which includes a fixed contact 19*a* and plate part 19*b*. The main body 27 has a longitudinal direction which is shown by the arrow 85. The case 61 of the first electromagnetic relay of the present embodiment is formed to a rectangular parallelepiped shape. The case 61 has outer surfaces 61*a*, 61*b*, 61*c*, and 61*d*.

The main body 27 is provided with a card 32. The card 32 has an engagement hole 32*c* which engages with an engagement part 16*a* of the armature 16. The end of the card 32 is formed with a pushing part 32*a*. The pushing part 32*a* is formed so that an end face becomes substantially parallel with the surface of the moving electrode plate 20. The planar shape of the card 32 is formed so as to become rectangular.

The moving electrode plate 18 and the fixed electrode plate 19 are arranged so that the width direction of the moving contact arrangement part and the width direction of the fixed contact arrangement part which is shown by the arrows 100 become substantially vertical to the movement direction of the card 32 which is shown by the arrow 82. Further, the moving contact arrangement part and the fixed contact arrangement part extend in a direction vertical to the longitudinal direction of the main body 27. By the electromagnet 12 being energized, the card 32 moves as shown by the arrow 82 and the moving electrode plate 20 is pushed against. As a result, the moving contact 20*a* contacts the fixed contact 19*a* and electrical conduction is achieved.

The base member 10 of the first electromagnetic relay of the present embodiment has a fixed part 10*f* which extends from the base part 10*a*. As shown in FIG. 17, the fixed part 10*f* extends up to the parts of the corners of the case 61 and is fastened to the case 61. That is, the main body 27 is fastened to the case 61. The first electromagnetic relay of the present embodiment is formed so that the movement direction of the card 32 is inclined with respect to the outer surfaces 61*a*, 61*b*, 61*c*, and 61*d* of the case 61. For this reason, the width direction of the moving contact arrangement part and the width direction of the fixed contact arrangement part are inclined with respect to the outer surfaces 61*a*, 61*b*, 61*c*, and 61*d* of the case 61. From the outer surface 61*b* of the case 61, terminals 21 and 22 stick out. The terminals 21 and 22 are inserted into the board 74 serving as an object to be mounted to whereby they are connected to the electrical circuit which is formed in the board 74.

The first electromagnetic relay of the present embodiment has a main body 27 including an electromagnet 12 inclined with respect to the outer surfaces 61*a*, 61*b*, 61*c*, and 61*d* of the case 61. Further, the main body 27 is inclined with respect to the mounting surface 74*a* of the board 74 when mounting the electromagnetic relay at the board 74. In the present embodiment, the longitudinal direction of the main body 27 is inclined with respect to the mounting surface 74*a*. Further, the width direction of the moving contact arrangement part and the width direction of the fixed contact arrangement part are inclined with respect to the mounting surface 74*a*. For this reason, even if the electromagnetic relay is mounted on the board 74 so that any surface among the outer surfaces 61*a*, 61*b*, 61*c*, and 61*d* of the case 61 becomes parallel to the gravity direction, the width direction of the moving contact arrangement part and the width direction of the fixed contact arrangement part can be made to be inclined with respect to the gravity direction and poor conduction due to foreign matter can be suppressed. For example, even if mounting the first electromagnetic relay of the present embodiment at the board 74 with a mounting surface 74*a* which extends in the horizontal direction or the gravity direction, it is possible to suppress poor conduction due to foreign matter.

Figure 18:
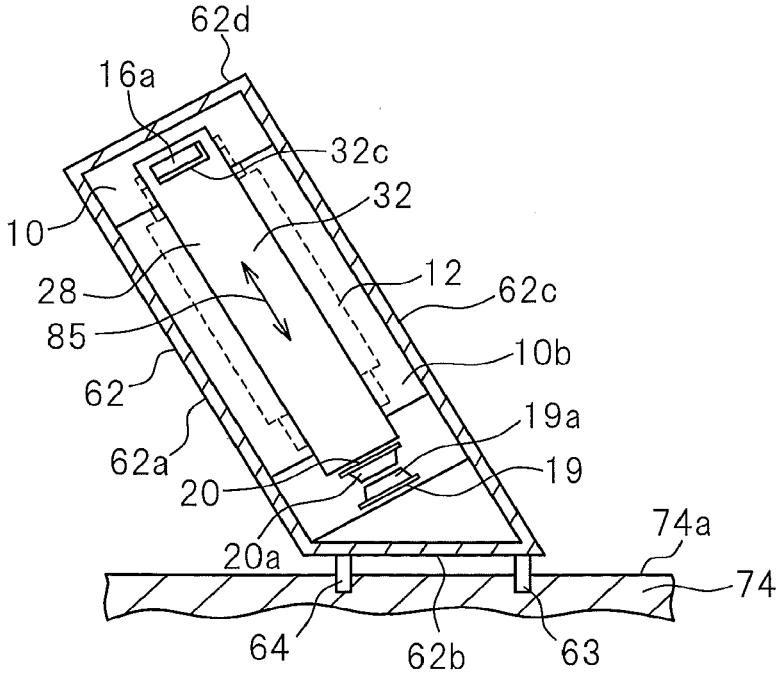
FIG. 18 is a schematic cross-sectional view when cutting the case of a second electromagnetic relay of the Embodiment 2.

FIG. 18 is a schematic cross-sectional view of a second electromagnetic relay of the present embodiment. The structure of the electromagnet 12, the card 32, the moving electrode plate 20, the fixed electrode plate 19, etc. of the main body 28 of the second electromagnetic relay of the present embodiment is similar to the first electromagnetic relay of the present embodiment. The moving contact arrangement part and the fixed contact arrangement part extend in the direction vertical to the longitudinal direction of the main body 28 which is shown by the arrow 85 as well in the same way as the first electromagnetic relay of the present embodiment. The second electromagnetic relay of the present embodiment differs in the structure of the base member 10 of the main body 28 and the shape of the case 62 from the first electromagnetic relay of the present embodiment.

The base member 10 of the second electromagnetic relay of the present embodiment does not have any fastening parts which extend toward the corner parts of the case 62. The side surfaces of the support part 10*b* contact the inner surfaces of the case 62. The case 62 is formed so that the cross-sectional shape when cut along a plane vertical to the moving contact arrangement part of the moving electrode plate 20 becomes trapezoidal. The outer surface 62*b* of the case 62 is inclined with respect to the outer surfaces 62*a* and 62*c*. Further, the outer surface 62*b* of the case 62 is inclined with respect to the outer surface 62*d*. For this reason, the width direction of the moving contact arrangement part and the width direction of the fixed contact arrangement part are inclined with respect to the outer surface 62*b*. The terminals 63 and 64 which are connected to the moving electrode plate 20 or the fixed electrode plate 19 and further are for connecting with external electrical circuits are arranged so as to project out from the outer surface 62*b*.

The second electromagnetic relay of the present embodiment can make the main body 28 to be inclined with respect to the mounting surface 74*a* of the board 74. In the present embodiment, the longitudinal direction of the main body 28 which is shown by the arrow 85 can be made to be inclined with respect to the mounting surface 74*a* of the board 74. The width direction of the moving contact arrangement part and the width direction of the fixed contact arrangement part can be made to be inclined with respect to the mounting surface 74*a* of the board 74. For this reason, even if mounting on the board 74 so that the outer surface 62*b* becomes vertical to or parallel with the gravity direction, the main body 28 can be made to be inclined with respect to the mounting surface 74*a* of the board 74. The width direction of the moving contact arrangement part and the width direction of the fixed contact arrangement part can be made to be inclined with respect to the gravity direction and poor conduction due to foreign matter can be suppressed. For example, even if mounting the second electromagnetic relay of the present embodiment on the mounting surface 74*a* of the board 74 which extends in the horizontal direction or the gravity direction, it is possible to suppress poor conduction due to foreign matter.

Figure 19:
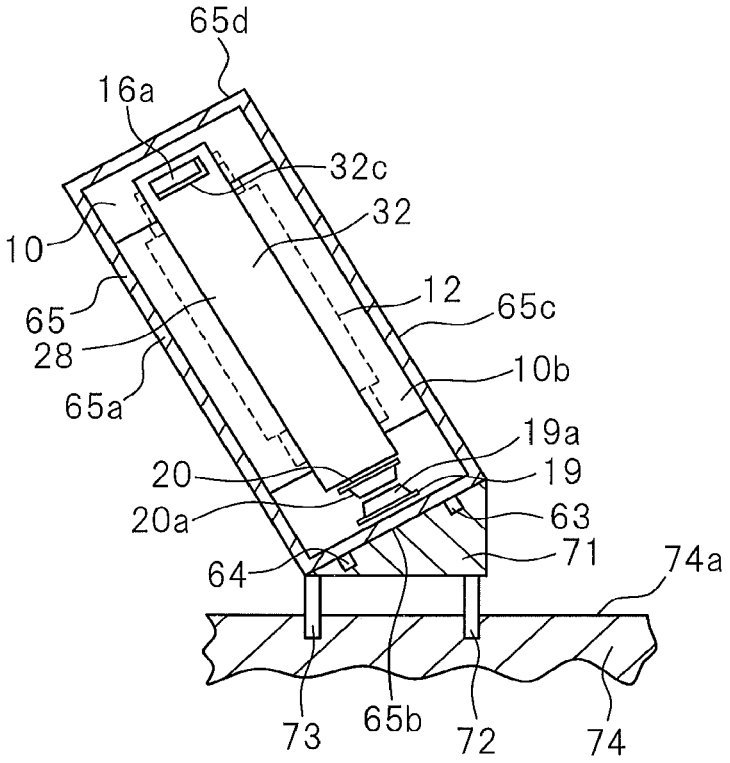
FIG. 19 is a schematic cross-sectional view when cutting the case of a third electromagnetic relay of the Embodiment 2.

FIG. 19 is a schematic cross-sectional view of a third electromagnetic relay of the present embodiment. The structure of the main body 28 which includes the electromagnet 12, the card 32, the moving electrode plate 20, and the fixed electrode plate 19 in the third electromagnetic relay of the present embodiment is similar to the second electromagnetic relay of the present embodiment. The third electromagnetic relay of the present embodiment differs in the shape of the case 65 from the case 62 of the second electromagnetic relay of the present embodiment. The case 65 of the third electromagnetic relay of the present embodiment is formed into a rectangular parallelepiped shape. The case 65 has outer surfaces 65*a*, 65*b*, 65*c*, and 65*d*.

The moving contact arrangement part of the moving electrode plate 20 and fixed contact arrangement part of the fixed electrode plate 19 extend in parallel. The width direction of the moving contact arrangement part and the width direction of the fixed contact arrangement part are vertical to or parallel with the outer surfaces 65*a*, 65*b*, 65*c*, and 65*d* of the case 65.

The third electromagnetic relay of the present embodiment is provided with a socket 71. The socket 71 connects the terminals 63 and 64 which are connected to the moving electrode plate 20 or the fixed electrode plate 19 and the electrical circuit which is formed on the board 74 serving as the object to be mounted to. The terminals 63 and 64 which stick out from the case 65 are mounted in the socket 71. The socket 71 has external connection terminals 72 and 73. The external connection terminals 72 and 73 are mounted on the board 74 and are electrically connected with the electrical circuit which is formed on the board 74.

The socket 71 is formed so that when mounting the third electromagnetic relay of the present embodiment on the board 74, the outer surfaces 65*a*, 65*b*, 65*c*, and 65*d* of the case 65 are inclined with respect to the mounting surface 74*a* of the board 74. That is, the socket 71 is formed so that the case 65 is inclined with respect to the mounting surface 74*a* of the board 74. Further, the socket 71 is formed so that when the electromagnetic relay is mounted on the board 74, the main body 28 is inclined with respect to the mounting surface 74*a* of the board 74. Furthermore, the socket 71 is formed so that when the electromagnetic relay is mounted on the board 74, the width direction of the moving contact arrangement part and the width direction of the fixed contact arrangement part are inclined with respect to the gravity direction.

The third electromagnetic relay of the present embodiment can make the main body 28 which includes the electromagnet 12 to be inclined with respect to the mounting surface 74*a* of the board 74. In the present embodiment, the longitudinal direction of the main body 28 which is shown by the arrow 85 can be made to be inclined with respect to the mounting surface 74*a*. The width direction of the moving contact arrangement part and the width direction of the fixed contact arrangement part are inclined with respect to the mounting surface 74*a*. For this reason, even if the electromagnetic relay is mounted on the board 74 where the mounting surface 74*a* extends in the horizontal direction or the gravity direction, the outer surfaces 65*a*, 65*b*, 65*c*, and 65*d* of the case 65 can be kept from becoming vertical to or parallel with the gravity direction. Further, the width direction of the moving contact arrangement part and the width direction of the fixed contact arrangement part can be made to be inclined with respect to the gravity direction and poor conduction due to foreign matter can be suppressed. Furthermore, by adding the socket 71 to the electromagnetic relay in the prior art, the width direction of the moving contact arrangement part and the width direction of the fixed contact arrangement part can be made to be inclined with respect to the gravity direction.

The rest of the configuration, actions, and effects are similar to those of the Embodiment 1, so explanations will not be repeated here.

The above embodiments may be suitably combined. In the above figures, the same or corresponding parts are assigned the same reference notations. Note that the above embodiments are illustrations and do not limit the invention. Further, in the embodiments, changes which are shown in the claims are included.

The invention claimed is:

1. An electromagnetic relay comprising:

an electromagnet;

an armature which is pulled by said electromagnet when said electromagnet is energized;

a moving electrode having a moving plate having a first longitudinal end fixed in place and a second longitudinal end movable by the operation of said armature, the second longitudinal end being opposite to the first longitudinal end in a longitudinal direction along a longitudinal axis of the moving electrode, and a moving contact disposed on the moving plate, said moving contact being moved by the operation of said armature; and a fixed electrode which faces said moving electrode and has a fixed plate and a fixed contact, wherein at least a portion of said moving plate and at least a portion of said fixed plate onto which said fixed contact is arranged are inclined in a moving plate width direction, perpendicular to the longitudinal axis of the moving plate.

2. The electromagnetic relay as set forth in claim 1, further comprising a moving member which is connected to said armature and which moves along with operation of said armature, wherein said moving plate and said fixed plate are inclined with respect to a movement direction of said moving member.

3. The electromagnetic relay as set forth in claim 2, wherein said moving member has a pushing part which pushes said moving plate, and said pushing part has a shape with an end face which contacts said moving plate becoming substantially parallel to a surface of said moving plate.

4. The electromagnetic relay as set forth in claim 2, wherein the moving plate moves by a pushing action in which the moving member pushes the moving plate.

5. The electromagnetic relay as set forth in claim 2, wherein the movement direction of said moving member is along a longitudinal direction of the said moving member.

6. The electromagnetic relay as set forth in claim 1, further comprising a case which has said electromagnet placed inside it, wherein said moving plate and said fixed plate are inclined with respect to at least one outer surface of said case.

7. The electromagnetic relay as set forth in claim 1, wherein said moving plate and said fixed plate are inclined with respect to a direction in which said armature is pulled by said electromagnet.

8. An electromagnetic relay comprising:

an electromagnet;

an armature that moves in accordance with excitation of said electromagnet;

a moving electrode including a moving plate and a moving contact disposed on the moving plate;

a fixed electrode including a fixed plate, and a fixed contact disposed on the fixed plate, the fixed contact configured to come into contact with the moving contact; and a card fixed to the armature, moving with the armature, and including a pushing part at an end of the card, the pushing part contacting and pushing the moving electrode upon movement of the armature, the pushing part being inclined with respect to a movement direction of the card, and the pushing part being substantially parallel to at least a portion of said moving plate and to at least a portion of said fixed plate.

* * * * *